US005382114A

United States Patent [19]

Trevisani

[11] Patent Number: 5,382,114

[45] Date of Patent: Jan. 17, 1995

[54] TUNNEL EXCAVATION APPARATUS

[75] Inventor: Davide Trevisani, Cesena, Italy

[73] Assignee: Trevi S.p.A., Cesena, Italy

[21] Appl. No.: 958,510

[22] Filed: Oct. 8, 1992

[30] Foreign Application Priority Data

Feb. 28, 1992 [IT] Italy ..... TO.92-A/00171

[51] Int. Cl.[6] ..... E21D 9/10; E21D 11/10

[52] U.S. Cl. ..... 405/140; 405/138; 405/146; 405/150.1

[58] Field of Search ..... 405/134, 140, 138, 142, 405/144, 146, 150.1, 150.2, 151, 152

[56] References Cited

U.S. PATENT DOCUMENTS

| | | | |
|---|---|---|---|
| 2,841,297 | 7/1958 | Washabaugh | 405/134 X |
| 2,895,299 | 7/1959 | Washabaugh | 405/134 |
| 3,597,929 | 8/1971 | Bodine | 405/140 |
| 4,666,336 | 5/1987 | Murakami et al. | 405/138 |
| 4,808,030 | 2/1989 | Takegawa | 405/146 |
| 4,917,538 | 4/1990 | Koga et al. | 405/150.1 |
| 5,104,260 | 4/1992 | Trevisani | 405/138 |
| 5,152,638 | 10/1992 | Trevisani | 405/140 |

FOREIGN PATENT DOCUMENTS

| | | |
|---|---|---|
| 0394806 | 10/1990 | European Pat. Off. . |
| 2679295 | 1/1993 | France . |
| 534378 | 9/1931 | Germany . |
| 1658769 | 6/1970 | Germany . |

*Primary Examiner*—Randolph A. Reese
*Assistant Examiner*—John Ricci
*Attorney, Agent, or Firm*—Merchant, Gould, Smith, Edell, Walter & Schmidt

[57] ABSTRACT

A tunnel excavation apparatus comprises a frame mounted on crawler tracks and provided with pistons comprising stabilizer feet, a power unit, a working unit, and auxiliary movement and positioning services. The working unit is arranged on an arm mounted on one end of telescopic uprights, which are hinged at their other ends to the frame about an axis substantially parallel to the longitudinal direction of the machine, and consists of a rectilinear rigid structure, at the perimeter of which excavation tools are arranged on a chain, to circulate along the side and front of the structure. The tools are hinged to a caisson open on the side opposite the hinged side and provided with apparatus for conveying concrete into its interior.

8 Claims, 8 Drawing Sheets

TUNNEL EXCAVATION APPARATUS

BACKGROUND OF THE INVENTION

This invention relates to a self-propelled tunnel excavation apparatus.

A known tunnel excavation method comprises constructing the final tunnel supporting lining before excavating the earth corresponding to the useful tunnel cross-section.

This method, which enables lining of considerable thickness (30–120 mm) to be achieved, is implemented by constructing a sequence of adjacent cast segments by the opening and closure panel technique. With this technique, each panel is formed by inserting a cutter unit into the earth and forming the concrete casting during the extraction of the tool by a casting tube which passes longitudinally through the cutter unit. The closure segments are made after cutting away a part of the concrete forming the two cast opening segments. The purpose of this operation is to dress the surface of the already hardened concrete of the primary segments to ensure good contact/connection with the fresh closure segment. Dressing is correctly used in construction work on any resumption of concrete casting.

The depth of the cast segments obtained in this manner is about 8.5 meters, after which the earth enclosed by them is excavated to depth of about 7 meters. After this a new series of cast segments is made, followed by excavation.

SUMMARY OF THE INVENTION

The object of the present invention is to provide a machine which enables a tunnel to be excavated by a continuous operation of earth excavation and concrete casting of the tunnel support lining, in which the adjacent cast segment method is replaced by a more rapid method in which the tunnel is constructed with a succession of frusto-conical rings which diverge in the direction of the tunnel excavation.

A further object of the invention is to form a tunnel within a reduced time, while overcoming the problem of possible water infiltration, as happens in the case of rings formed from longitudinal cast segments.

A further object is to overcome the limitations of the methods currently used for "presplitting".

Presplitting is used in tunnel construction to form temporary reduced-thickness linings (15–25 cm). This consists of using a cutter chain (conceptually similar to that proposed herein) which is inserted axially into the earth along the outer perimeter of the tunnel, and is then driven along its development to form cast segments of about 3–5 metres extension and having a depth of at most 4–5 metres. The cavity formed in this manner is then filled with sprayed concrete when the cutter chain has been extracted. The first limitation of this method is the small thickness which can be achieved, this being because of the flexural stresses which arise at the connection between the cutter chain and the base machine support which supports it. The second limitation is that the earth has to be self-supporting (i.e. the cavity opened by the cutter chain has to remain intact) to enable the segment cavity to be filled with sprayed concrete. In contrast, the present invention enables casting to take place within the cavity opened by the cutter module simultaneously with the advancement of the module and within a caisson rigid with the cutter module itself.

A further object of the present invention is to propose an apparatus using a new cutter element by which, when inserted into the earth (as in the case of forming the first opening diaphragm), is able to move transversely alone the development of the section to be excavated, whereas immediately behind it the excavated cavity is simultaneously filled with pumped concrete.

Consequently opening and closure segments are no longer formed, but instead a single circular (or rather frusto-conical) ring/vault is formed. The earth or rock is therefore cut along one side of the chain carrying the excavation tools (shoes, picks or cutters, depending on the hardness of the earth or rock).

In order not to subject the cutter module support and guide structure to flexure or torsion, it is provided with a series of rolling and/or sliding elements, the purpose of which is to guide and/or retain the cutter module while at the same time maintaining it on the correct excavation line and eliminating any flexural stress on the element which connects the cutter module to the support structure. During the beginning and end of excavation these guide members remain within the outline of the cutter element whereas during the cutting stage they are made to move outside the outline by a series of cams/pistons (or another system), to react against the earth or rock. These guide members can be operated by a mechanical shaft, or a hydraulic or other equivalent connection system synchronously with the advancement (rotation) of the cutter element.

A further object of the invention is to provide a machine which enables structural rings to be constructed which are of single type and hence more suitable for absorbing the stresses induced by the surrounding external earth and for redistributing any load unevenness.

These and further objects and advantages, which will be more apparent from the ensuing description, are attained according to the invention by a tunnel excavation apparatus comprising a frame mounted on crawler tracks and provided with pistons comprising stabilizer feet, a power unit operating at least one working unit, and auxiliary movement and positioning services, the working unit being arranged on an arm mounted on one end of telescopic uprights, which are hinged at their other end to the frame about an axis substantially parallel to the longitudinal direction of the machine, characterised in that the working unit consists of a rectilinear rigid structure, at the perimeter of which excavation tools are arranged on a chain, to circulate along the side and front of the structure, there being hinged to the side of said unit, on an axis substantially parallel to the structure, a caisson open on the side opposite the hinged side and provided with means for conveying concrete into its interior.

BRIEF DESCRIPTION OF THE DRAWINGS

The structural and operational characteristics of two preferred but non-limiting embodiments of an apparatus according to the invention are described hereinafter with reference to the accompanying drawings, in which.

DETAILED DESCRIPTION OF THE PREFERRED EMBODIMENTS

Figure 1:
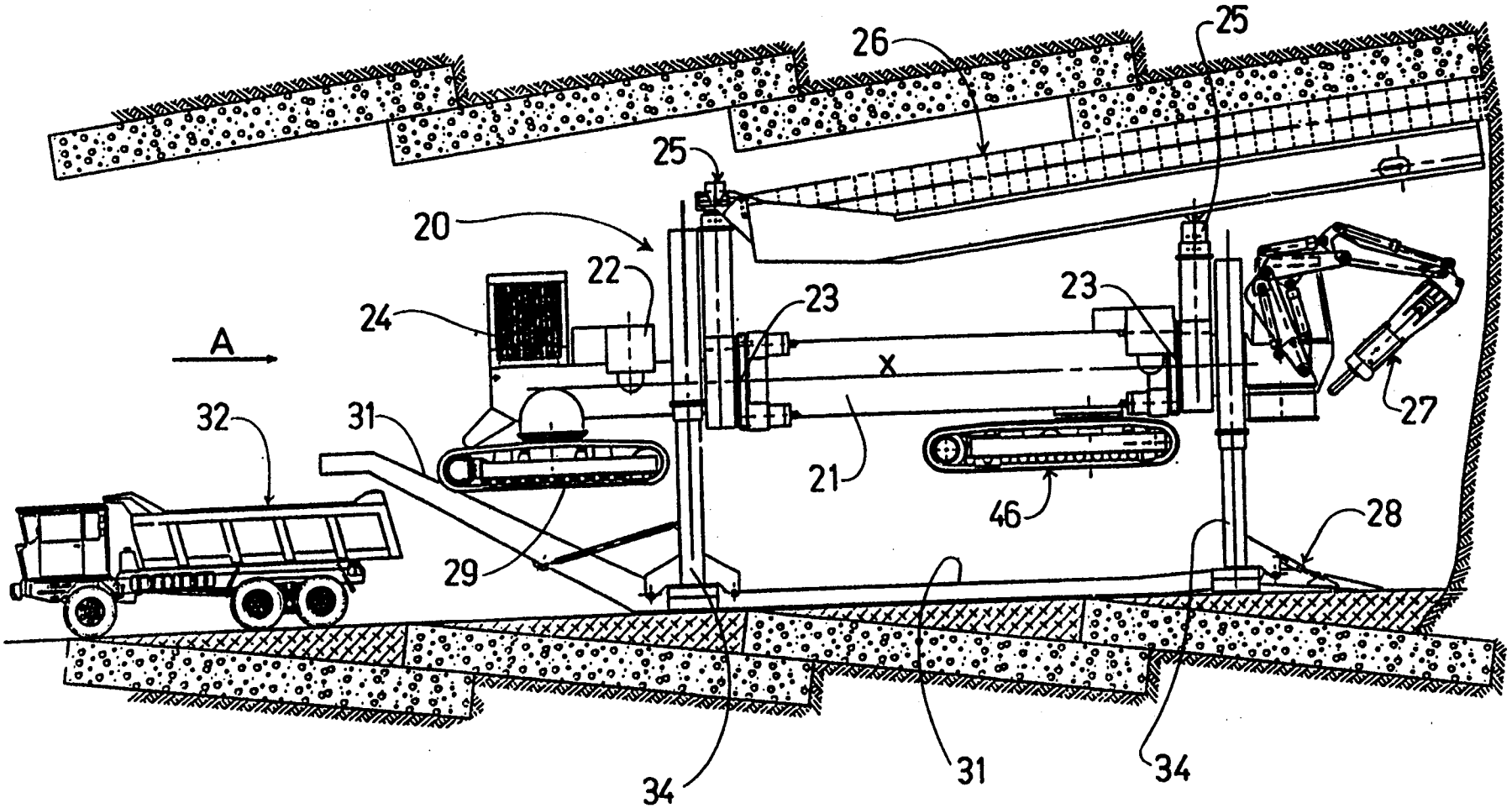
FIG. 1 is a longitudinal view of a first embodiment of the apparatus according to the invention.
Figure 2:
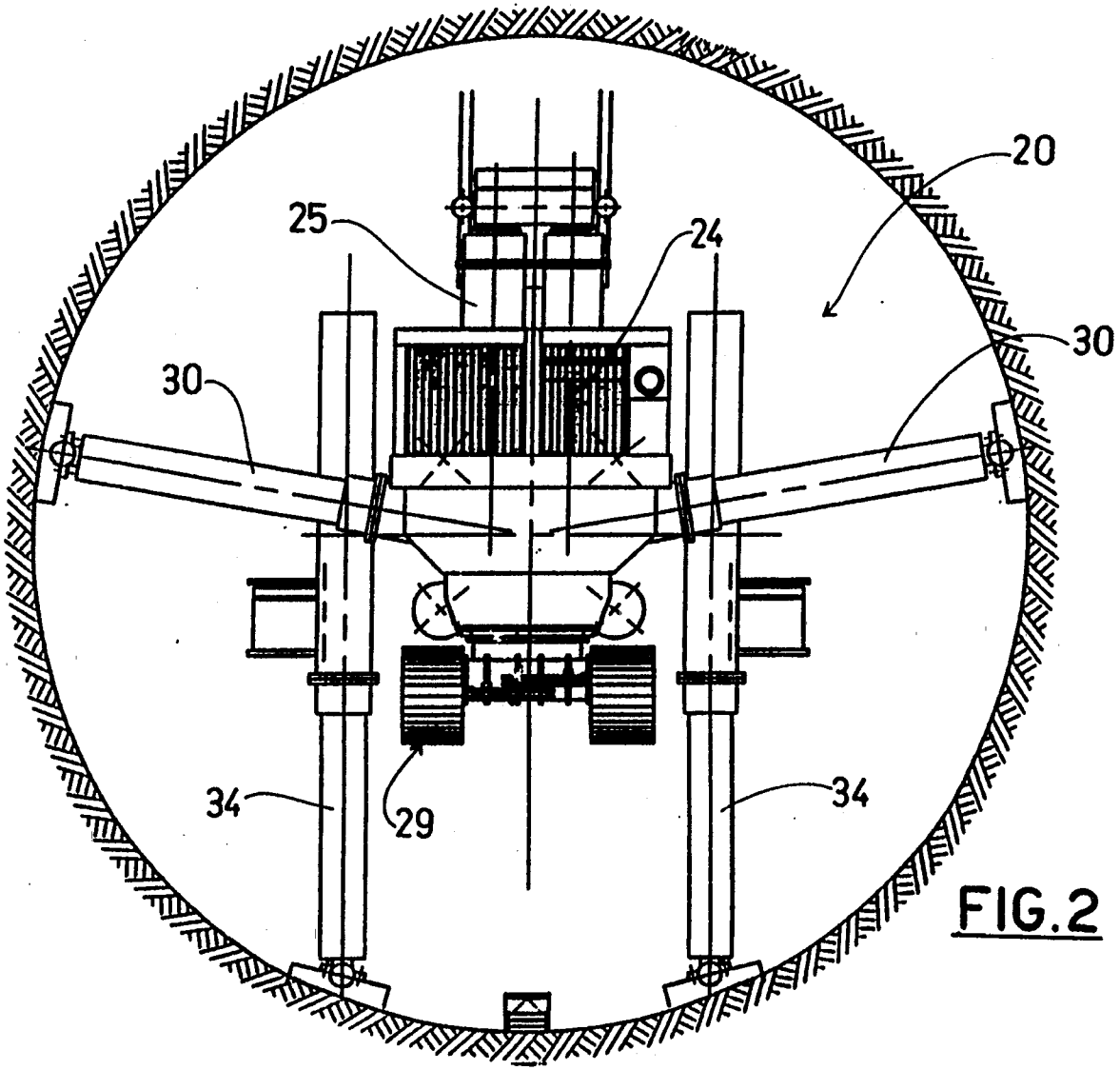
FIG. 2 is a front view of the apparatus in the direction of the arrow A of FIG. 1.

With reference initially to FIG. 1, the reference numeral 20 indicates overall a self-propelled excavation apparatus according to the present invention. The apparatus 20 comprises a central frame 21 supported rotatable about a horizontal axis x by thrust bearings 23 mounted on an outer frame 22. The frame 22 supports a drive unit 24 able to operate all the working components of the apparatus, and is sustained by telescopic positioners 30 and 34 which provide secure fixing of the apparatus 20 and its correct positioning coaxial with the tunnel (FIG. 2).

Again with reference to FIG. 1, the apparatus comprises telescopic uprights 25 the purpose of which is to support, and adjust the height and inclination of, an excavation module or groups of modules, indicated overall by 26. The self-propelled apparatus 20 comprises at its front an excavation unit 27 for removing the earth.

On the base at the front end of the apparatus 20 there is a "raclette" service unit 28 the purpose of which is to collect both the excavation debris and the earth removal debris and to convey it, via a conveyor belt 31, onto a transport vehicle 32 positioned behind the apparatus 20.

The apparatus is completed by two crawler-tracked units 29 and 46 for shifting the apparatus 20 (this shifting is not shown on the drawings); the crawler-tracked unit 46 is compass-openable to provide greater stability to the structure.

Figure 3:
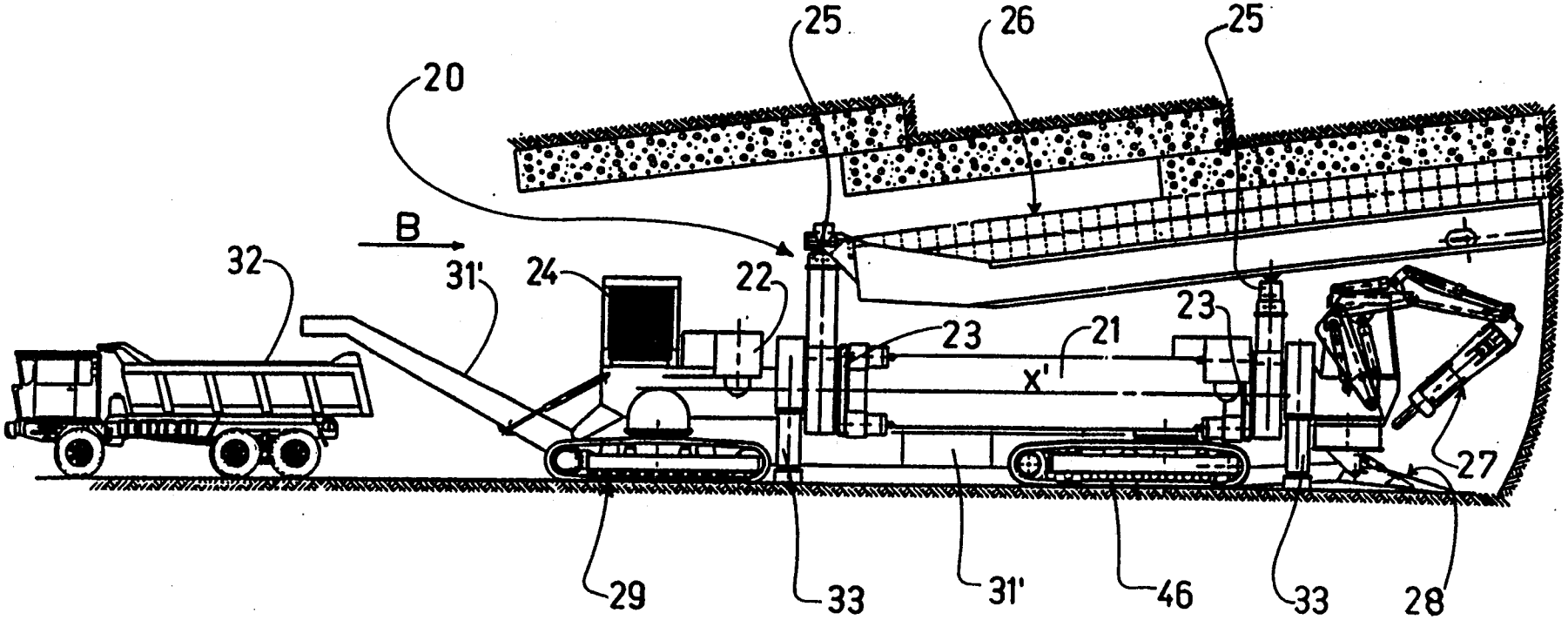
FIG. 3 is a longitudinal view of a second embodiment of the apparatus according to the invention.
Figure 4:
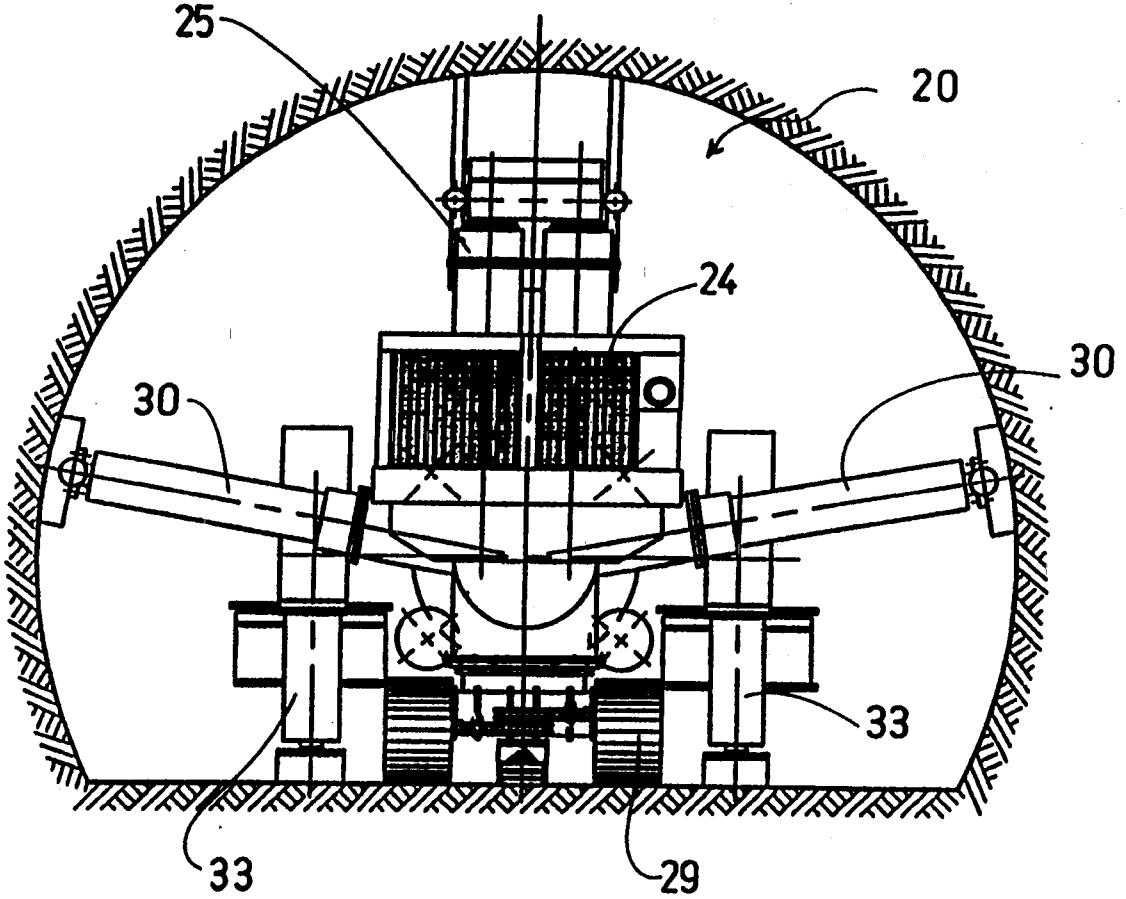
FIG. 4 is a front view of the apparatus of FIG. 3 in the direction of the arrow B.

With reference to FIGS. 3 and 4, these show a modified embodiment which is conceptually similar to the apparatus shown in FIGS. 1 and 2 but is arranged to form tunnel sections of partial vault or circular arch type.

As can be seen, in FIGS. 3 and 4 the apparatus 20 rests on the round via the crawler-tracked units 29 and 45, so that the tunnel axis x' is situated lower. The components which differentiate it from the preceding embodiment are the stabilizers 33, the conveyor belt 31' and other constructional details, which are not shown but are related to the fact that in this case the apparatus 20 rests on a surface which is fiat or inclined to the horizontal, or on an existing road surface in the case of a tunnel to be widened, for example from 2 to 3 lanes per travel direction.

Figure 5:
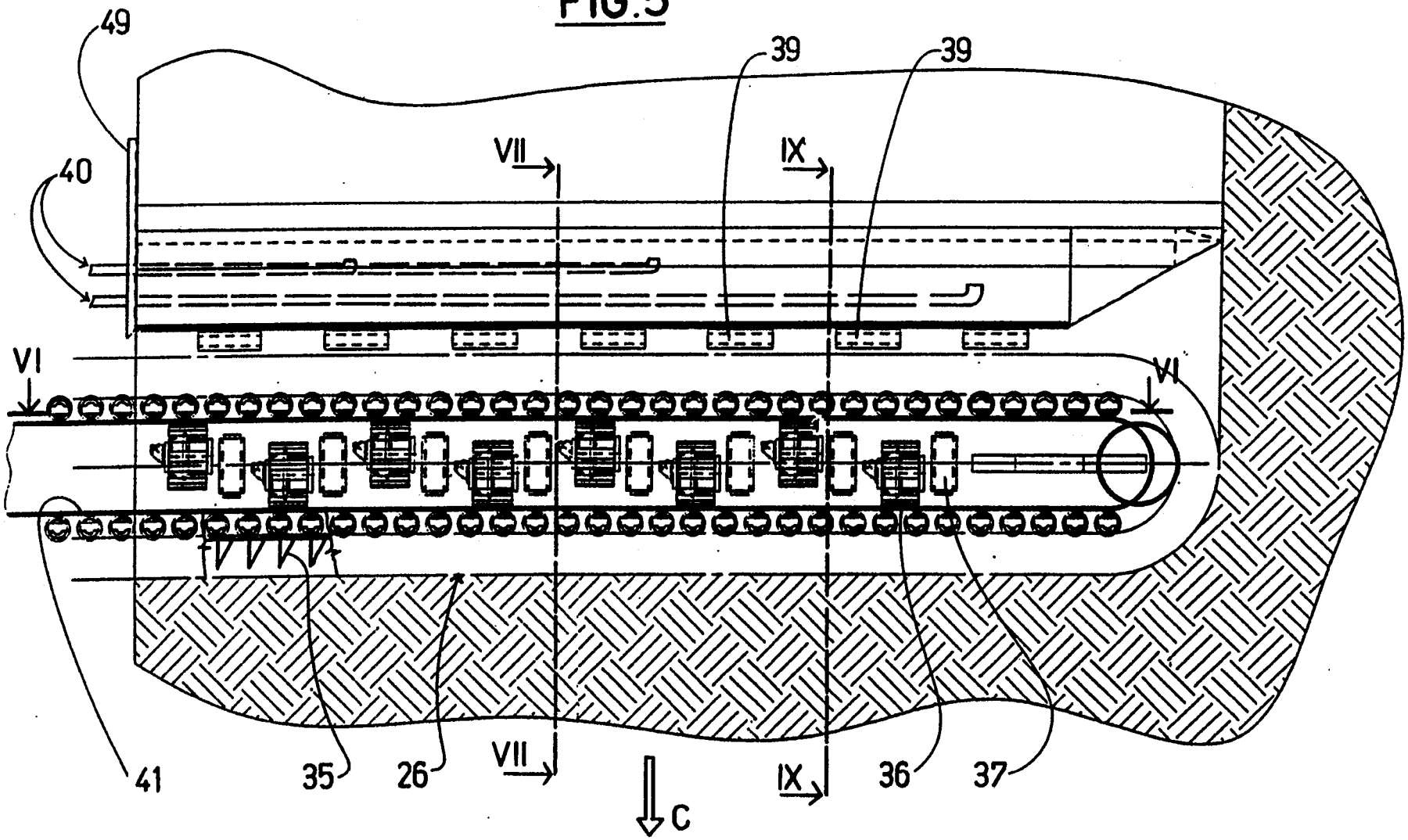
FIG. 5 is a plan view of a detail of the apparatus during a stage in the progress of the excavation of a tunnel.

With reference to FIG. 5, which represents a plan view of an excavation module 26 shown inserted into the excavation and under working conditions, said module 26 comprises essentially a front cutter unit hinged to a rear caisson 38. When the cutter module and caisson 38 have been inserted into the earth, the apparatus 20 is made to form a frusto-conical ring (complete or incomplete, depending on whether the apparatus is that of FIG. 1 or that of FIG. 3) by rotating the telescopic uprights 25 about the axes x (or x'). In this manner the module 26 describes a circumference (or circumferential arc) coinciding with the tunnel vault, by excavating a trench and simultaneously filling it with pumped concrete. The earth lying within the concrete fine is then removed and a new cycle comprising excavation, casting and earth removal can then begin, and so on.

Again with reference to FIG. 5, the module 26 is provided at its front with excavation tools. For clarity of description, in FIGS. 5 and 7–10 the direction followed by the excavation tools 35 is indicated by the arrow C. Said excavation tools 35 are arranged on a chain and circulate along the perimeter of their structure 41. These tools are the elements which produce the cutting action and removal of debris at the excavation face. Within its structure 41, the module 26 also comprises a series of wheels 36 and shoes 37 the purpose of which is to effect, guide and (if necessary) brake the advancement of the entire cutter unit along the cutting line in the correct manner.

Figure 6:
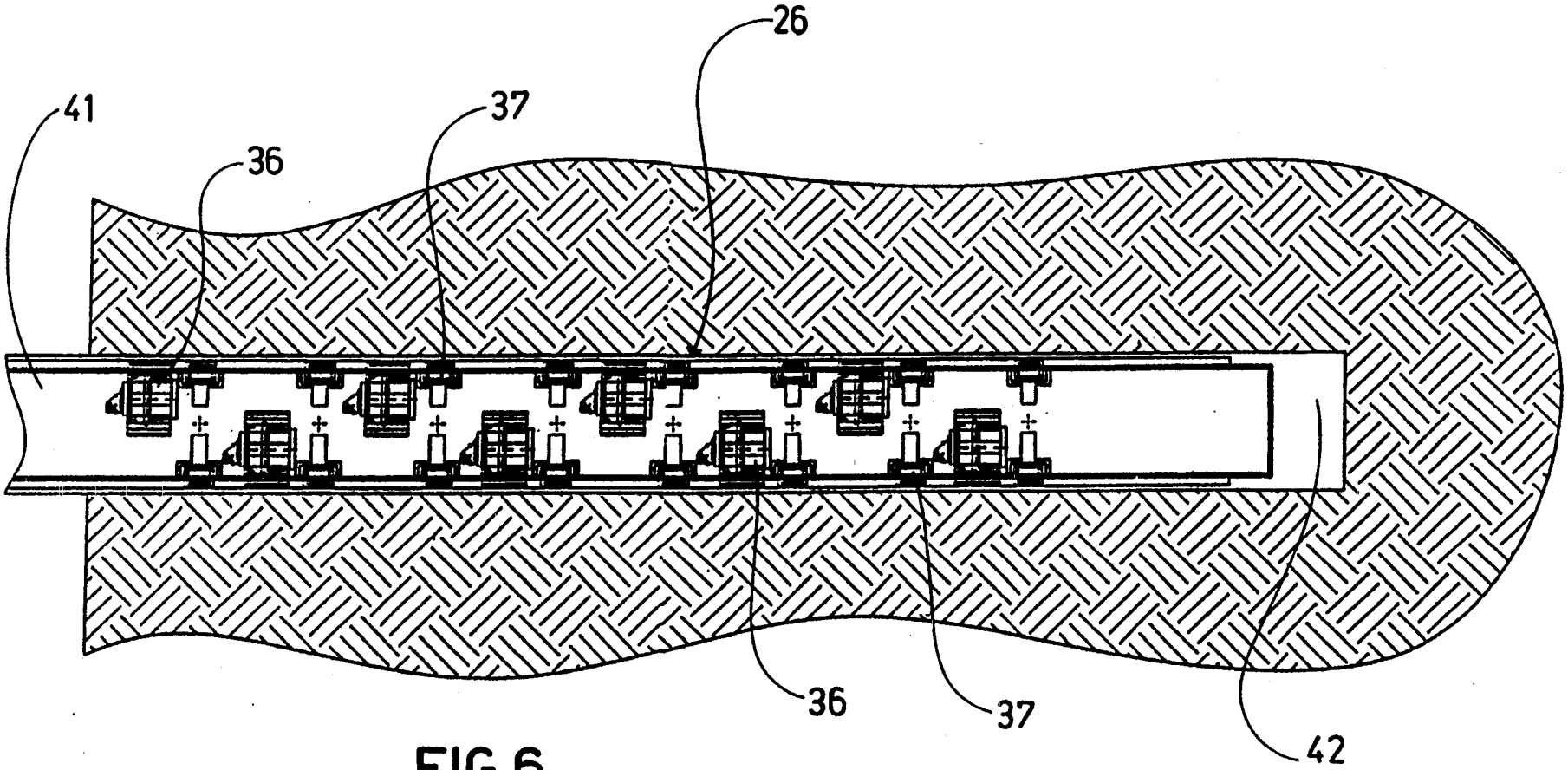
FIG. 6 is an axial section on the line VI—VI of FIG. 5.

In FIGS. 5 and 6 the elements 36 and 37 shown disengaged from the excavation/cutting wall.

This configuration is that in which the module or modules enter or leave when forming the tunnel vault. The elements 36 and 37 are used when the module describes its cutting trajectory. It is during this stage that they are required to perform their task of controlling the advancement of the cutter module along the excavation line.

The concrete-containing caisson 38 follows the module 26, connected thereto by articulated connectors 39. Said caisson, the dimensions of which are equal to the excavation thickness, travels along the excavation walls in contact therewith. The caisson structure can be formed of elastic material to adapt perfectly to the excavation walls.

The concrete is fed into it by pumping systems, via one or more pipes 40.

Figure 7:
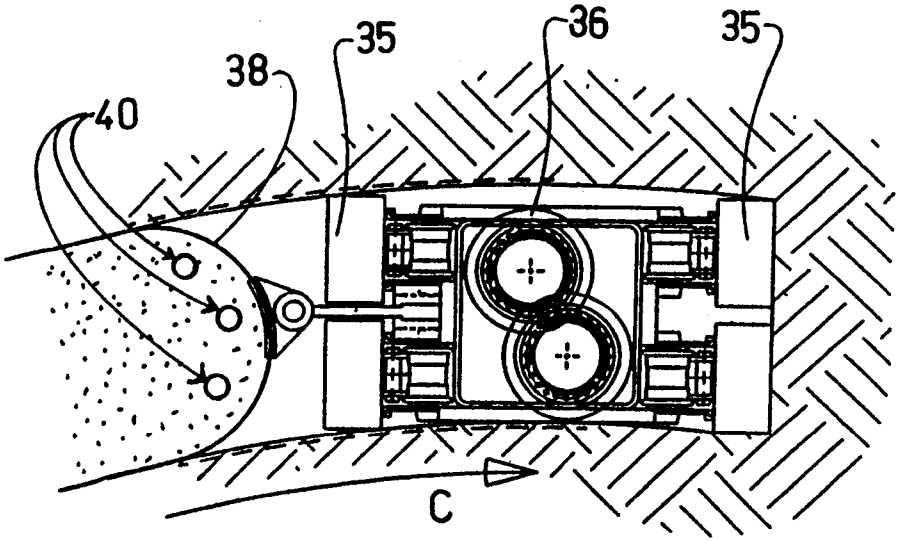
FIG. 7 is a radial section on the line VII—VII of FIG. 5.
Figure 8:
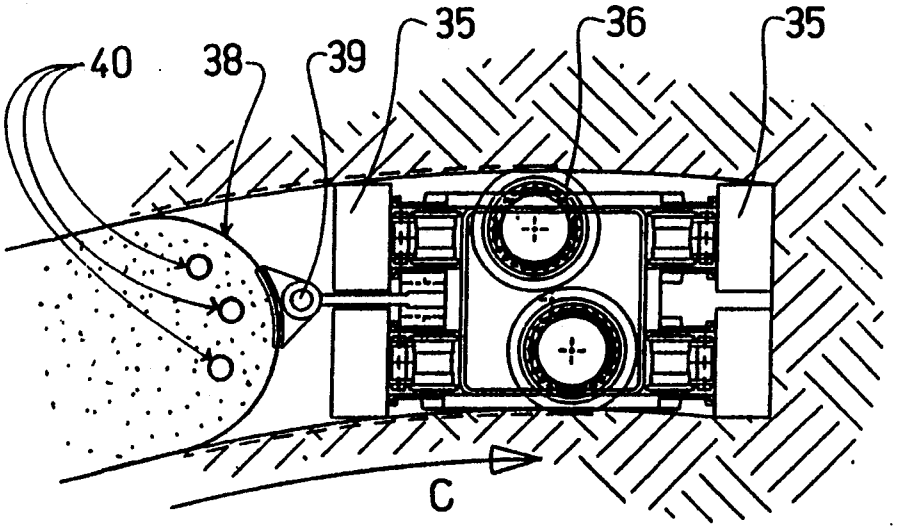
FIG. 8 shows the detail of FIG. 7 in another working configuration.

The hydrostatic pressure of the concrete helps not only to fill the entire cavity formed by the module, but also to transmit a considerable advancement thrust to it, any escape of still fluid concrete from the excavation face being prevented by a cover 49 which retains it until it has set (possibly quick-setting concrete). In this manner the excavated cavity 42 does not suffer from relaxation of the surrounding earth. FIGS. 7 and 8 show the drive/guide/braking wheels 36 in positions respectively disengaged from and engaged with the excavation walls. These members, which can be individually operated and controlled, can be driven by direct mechanical, hydraulic or equivalent connections (shafts, motors, cams, pistons etc.) which are not described herein as they do not form part of the present invention.

Figure 9:
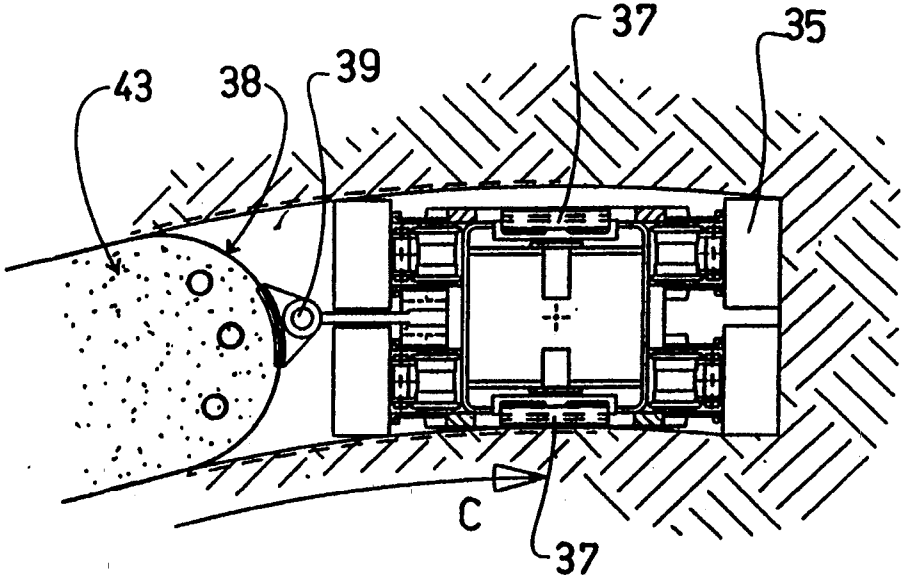
FIG. 9 is a radial section on the line IX—IX of FIG. 5.
Figure 10:
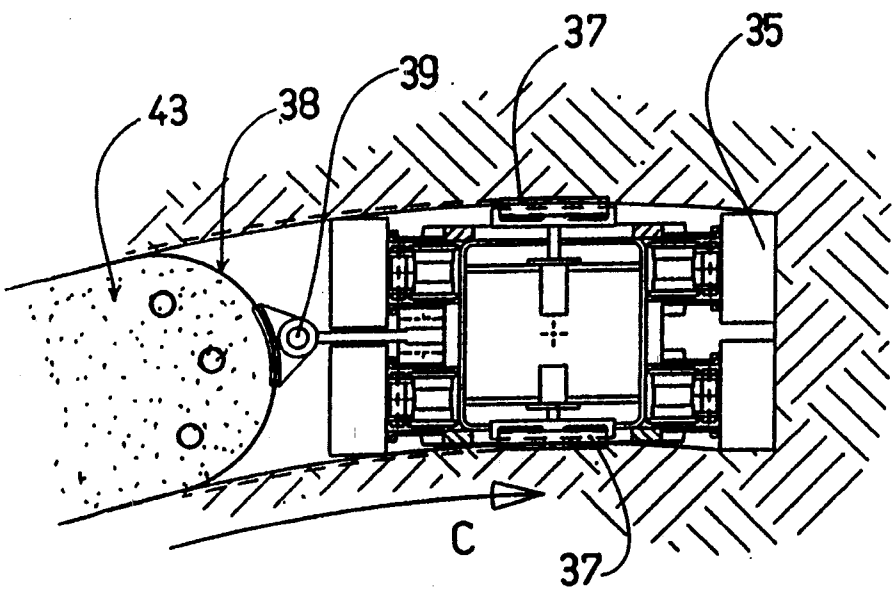
FIG. 10 shows the detail of FIG. 9 in another working configuration.

FIGS. 9 and 10 show the guide shoes 37 in positions respectively disengaged from and engaged with the excavation walls. These members can also be individually operated and controlled, and can be driven by direct mechanical or hydraulic or equivalent connections (pistons, cams etc.).

The rolling and/or sliding elements 36 and 37 eliminate any flexural stress on the element which connects the cutter module to the support structure.

A further purpose of said guide members is to control the advancement of the cutter module on the basis of the resistance of the material to be excavated, utilizing the thrust effect created by the pressure-casting of the concrete in the rear casting chamber.

In order to be able to excavate hard rock formations or stratified rock with different hardness values, a considerable force (so high as not to be able to be supported by projecting structures) has to be transmitted to the excavation tools (picks, cutters).

In contrast, if this force is too high for soft earth, it results in the tools becoming jammed by sinking into the earth.

A further important novel characteristic of the present invention is that this force is obtained by combining the drive action (in hard ground) or braking action (in soft ground) of the motorized rolling/sliding elements (wheels or shoes) with the virtually uniform thrust of the concrete pumped under pressure into the casting chamber 43 directly behind the cutter element.

The combination of controlling the applied power for driving the elements (wheels or shoes) projecting above and below the cutter element and strictly adhering to the earth, and the pressure involved in pumping the concrete into the casting chamber left free by the cutter element, optimizes the thrust on the excavation tools and hence the advancement rate of the cutter element for any type and hardness of earth or rock encountered and for any situation of unevenness in hardness.

The concrete is laid under pressure in the casting chamber bounded:

- on one side by the caisson 38 which transmits the thrust to the excavation tools:
- on three sides (upper, lower and end) by the natural earth mass;
- frontally by the cover 49 kept pressed against the excavation face and slidable with the module/-modules 26;
- on the last side by the already cast concrete under quick setting, aided by the effect of the pumping pressure which prevents relaxation of the surrounding earth and its slippage into the region excavated by the cutter element.

This lack of relaxation of the earth surrounding the excavation reduces the thrust on the final tunnel lining formed in this manner and ensures its formation under maxim operating safety both for personnel and for equipment.

Any deviation of the cutter module from the theoretical cutting trajectory induce abnormal stresses in the element which connects at to the support structure. By measuring these stresses it is possible, using an electronic control system, to act on the guide and transmission elements to maintain and/or correct the cutting trajectory.

After finishing the entire ring, or that amount of lining section required by the design (if the inverted arch is not to be constructed directly), the guide members 36 and 37 are made to retract to within the outline and the cutter module is extracted, the space occupied by it being filled with concrete pumped through a central pipe in the module as in the case of patent application Ser. Nos. 3446 A/89 and T091A805/91 of the present applicant. The ring formed in this manner has a length of about 8 m and a thickness of up to 120 cm.

The equipment provided for forming the ring, which as stated represents the final load-bearing lining of the tunnel, is such as to enable both the entire circular cross-section of the tunnel to be formed or just its vault (in those cases in which the design requires the construction of the inverted arch later).

As will be apparent, the present invention provides various advantages, of which some are common to the known art, such as:

- formation of the final load-bearing lining of the tunnel before removing its enclosed earth:
- ability to operate with the same apparatus in tunnels of different diameter by simply adjusting the extension of the support pistons;
- absolute safety for personnel, who always operate within a load-bearing concrete structure, possibly fibre-reinforced;
- energy saving by virtue of cutting the earth only at the earth ring corresponding to the thickness of the final load-bearing lining to be constructed.

The invention also achieves the following further advantages:

- reduction in the time for constructing the entire ring;
- elimination of possible water infiltration, as happens at the joints in the case of a ring formed from individual segments;
- single structural ring (instead of several segments) and hence more suitable for absorbing the stresses induced by the external earth mass due to relaxation of the earth above the excavation, and more suitable for redistributing any load unevenness;
- further energy saving consequent on the virtually uniform thrust of the pumped concrete on the excavation tools and hence a reduction in the hydraulic power required for forward movement.

Although only two preferred embodiments of the apparatus have been described, the invention is not limited to these and numerous modifications obvious to the expert of the art can be made thereto without leaving the scope of the invention, as defined by the following claims.

I claim:

1. A tunnel excavation apparatus comprising a frame mounted on crawler tracks and provided with pistons comprising stabilizer feet, a power unit operating at least one working unit, and auxiliary movement and positioning services, the working unit being arranged on an arm mounted on one end of telescopic uprights, which are hinged at their other ends to the frame about an axis substantially parallel to the longitudinal direction of the machine, characterized in that the working unit comprises a rectilinear rigid structure, at the perimeter of which excavation tools are arranged on a chain, to circulate along the side and front of the structure, there being hinged to the side of said working unit, on an axis substantially parallel to the structure, a caisson open on the side opposite the hinged side and provided with means for conveying concrete into an interior of said caisson.

2. An apparatus as claimed in claim 1, characterized in that the caisson has a height substantially equal to a thickness of the excavation executed by the working unit.

3. An apparatus as claimed in claim 1, characterized in that the structure of the working unit is also provided with shoes and rollers extendable alternately into contact with the walls of the excavation to guide the advancement of the excavation tools, and retractable simultaneously for entry and exit of the working unit into and from the excavation.

4. An apparatus as claimed in claim 3, characterized in that the shoes and rollers are arranged alternately on those faces of the structure opposite to those provided with excavation tools.

5. An apparatus as claimed in claim 3, characterized in that the shoes and rollers are arranged alternately on those faces of the structure perpendicular to those provided with excavation tools.

6. An apparatus as claimed in claim 1, characterized in that the structure of the working unit is also provided with shoes and rollers extendable simultaneously into contact with the walls of the excavation to guide the advancement of the excavation tools, and retractable simultaneously for entry and exit of the working unit into and from the excavation.

7. A tunnel excavation method using an apparatus as claimed in claim 4, characterized by comprising the steps of:

a) forming a longitudinal excavation at an angle to the horizontal by inserting the working unit and the caisson associated therewith into the earth with the shoes and rollers in their retracted position;

b) moving the working unit along an arched trajectory of the tunnel with consequent excavation into the earth during advancement, with the shoes and rollers in their extended position;

c) continuously injecting concrete into the caisson to the side of the working unit during its movement along the arched trajectory;

d) extracting the working unit from the excavation on termination of the arched trajectory with the rollers and shoes in their retracted position;

e) removing the earth enclosed by the excavation;

f) advancing the working unit at the same inclination as the preceding step b) to commence a new cycle in the same manner as the preceding steps b) through e).

8. A method as claimed in claim 7, characterized in that during the continuous injection of the concrete into the caisson the advancement of said working unit is controlled by controlling the injection pressure, the flow rate and the speed of entry of the concrete into the caisson.

* * * * *

UNITED STATES PATENT AND TRADEMARK OFFICE
CERTIFICATE OF CORRECTION

PATENT NO. : 5,382,114

DATED : January 17, 1995

INVENTOR(S) : Davide Trevisani

It is certified that error appears in the above-identified patent and that said Letters Patent is hereby corrected as shown below:

ON THE TITLE PAGE:

item [30], "TO.92-A/00171" should be --TO.92A/000171--.

In column 1, line 12, "lining" should be --linings--.

In column 1, line 29, insert --a-- before "depth".

In column 2, line 7, "alone" should be --along--.

In column 3, line 54, "round" should be --ground--.

In column 4, line 9, "fine" should be --ring--.

In column 5, line 46, "maxim" should be --maximum--.

In column 5, line 61, "application" should be --applications--.

Signed and Sealed this

Fifth Day of December, 1995

*Attest:*

*Attesting Officer*

Bruce Lehman

BRUCE LEHMAN

*Commissioner of Patents and Trademarks*